US011539122B2

(12) United States Patent
Takayama et al.

(10) Patent No.: US 11,539,122 B2
(45) Date of Patent: Dec. 27, 2022

(54) ANTENNA MODULE AND COMMUNICATION UNIT PROVIDED WITH THE SAME

(71) Applicant: Murata Manufacturing Co., Ltd., Kyoto (JP)

(72) Inventors: Keisei Takayama, Kyoto (JP); Kengo Onaka, Kyoto (JP); Kaoru Sudo, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 84 days.

(21) Appl. No.: 17/074,962

(22) Filed: Oct. 20, 2020

(65) Prior Publication Data

US 2021/0036414 A1 Feb. 4, 2021

Related U.S. Application Data

(63) Continuation of application No. PCT/JP2019/013931, filed on Mar. 29, 2019.

(30) Foreign Application Priority Data

Apr. 27, 2018 (JP) ..... JP2018-086461

(51) Int. Cl.
*H01Q 1/40* (2006.01)
*H01Q 5/378* (2015.01)
(Continued)

(52) U.S. Cl.
CPC ..... *H01Q 1/40* (2013.01); *H01Q 1/48* (2013.01); *H01Q 5/378* (2015.01); *H01Q 1/243* (2013.01)

(58) Field of Classification Search
CPC ..... H01Q 5/378; H01Q 5/385; H01Q 21/065; H01Q 9/0407; H01Q 9/0414
See application file for complete search history.

(56) References Cited

U.S. PATENT DOCUMENTS

2007/0236390 A1 10/2007 Chang
2012/0242547 A1 9/2012 Fujii et al.
(Continued)

FOREIGN PATENT DOCUMENTS

JP 2007-282174 A 10/2007
JP 2008-061030 A 3/2008
(Continued)

OTHER PUBLICATIONS

International Search Report issued in Application No. PCT/JP2019/013931, dated Jun. 11, 2019.
(Continued)

*Primary Examiner* — Ricardo I Magallanes
(74) *Attorney, Agent, or Firm* — Pearne & Gordon LLP

(57) ABSTRACT

An antenna module (100) includes a dielectric substrate (130) having a multilayer structure, a first radiating electrode (121) and a ground electrode (GND) that are disposed in the dielectric substrate (130), and a second radiating electrode (150) disposed in a layer between the first radiating electrode (121) and the ground electrode (GND). The first radiating electrode (121) is a power feed element to which radio frequency power is supplied. When the antenna module (100) is viewed in plan from a normal direction of the dielectric substrate (130), the first radiating electrode (121) and the second radiating electrode (150) at least partially overlap with each other. A thickness of the second radiating electrode (150) is larger than that of the first radiating electrode (121).

19 Claims, 7 Drawing Sheets

(51) Int. Cl.
*H01Q 1/48* (2006.01)
*H01Q 1/24* (2006.01)

(56) References Cited

U.S. PATENT DOCUMENTS

| | | | | |
|---|---|---|---|---|
| 2016/0276751 | A1 | 9/2016 | Ueda | |
| 2017/0222316 | A1 | 8/2017 | Mizunuma et al. | |
| 2019/0115645 | A1* | 4/2019 | Chang | H01Q 3/38 |
| 2020/0412022 | A1* | 12/2020 | Yun | H01Q 9/0435 |

FOREIGN PATENT DOCUMENTS

| | | | |
|---|---|---|---|
| JP | 2012/019421 | A | 1/2012 |
| JP | 2012-204848 | A | 10/2012 |
| WO | 2015/083457 | A1 | 6/2015 |
| WO | 2016/063759 | A1 | 4/2016 |

OTHER PUBLICATIONS

Written Opinion issued in Application No. PCT/JP2019/013931, dated Jun. 11, 2019.

* cited by examiner

ANTENNA MODULE AND COMMUNICATION UNIT PROVIDED WITH THE SAME

CROSS REFERENCE TO RELATED APPLICATIONS

This is a continuation of International Application No. PCT/JP2019/013931 filed on Mar. 29, 2019 which claims priority from Japanese Patent Application No. 2018-086461 filed on Apr. 27, 2018. The contents of these applications are incorporated herein by reference in their entireties.

BACKGROUND OF THE DISCLOSURE

Field of the Disclosure

The present disclosure relates to an antenna module and a communication unit provided with the same, and more specifically, to a technique for expanding a frequency band of an antenna module.

Description of the Related Art

An antenna module in which a radiating element (radiating electrode) and a radio frequency semiconductor device are integrated is disclosed in International Publication No. 2016/063759 (Patent Document 1).

Patent Document 1: International Publication No. 2016/063759 Pamphlet

BRIEF SUMMARY OF THE DISCLOSURE

In general, a peak gain and a frequency band width of a radio wave radiated from the antenna module are determined by a strength of an electromagnetic field coupling between a ground electrode and the radiating electrode. Specifically, as the electromagnetic field coupling becomes stronger, the peak gain increases and the frequency band width decreases, and conversely, as the electromagnetic field coupling becomes weaker, the peak gain decreases and the frequency band width increases.

The strength of the electromagnetic field coupling is influenced by the distance between the ground electrode and the radiating electrode, that is, the thickness of the antenna module.

The antenna module may be used in a mobile electronic device such as a mobile phone or a smartphone, for example. In such applications, reducing the size and thickness of the antenna module itself is also desired for reducing the size and thickness of the device body.

Meanwhile, there is a case where an expansion of the frequency band width of a radio wave that may be transmitted and received by an antenna module is also demanded for the purpose of an increase of the communication speed and an improvement of the communication quality or the like. As described above, in order to expand the frequency band width, it is necessary to weaken the strength of the electromagnetic field coupling between the ground electrode and the radiating electrode, and in that case, it is necessary to secure the distance between the ground electrode and the radiating electrode by making the thickness of the antenna module as large as possible.

That is, in order to achieve the reciprocal needs for thinning of the antenna module and expanding of the frequency band width, it is necessary to increase the thickness of the antenna module as much as possible within a designed dimension of the antenna module permissible for the device size.

The thickness of the antenna module is determined mainly by the thickness of a dielectric substrate in which the ground electrode and the radiating electrode are disposed. On the other hand, the thickness of each layer in the dielectric substrate having a multilayer structure is also limited to some extent. Accordingly, in order to increase the thickness of the dielectric substrate, it is necessary to increase the number of layers constituting the dielectric substrate. However, when the number of layers is increased, laminating steps in manufacturing process increase, and manufacturing cost may increase.

The present disclosure has been made in order to solve the above-described problem, and an object thereof is to expand a frequency band width without changing the number of layers in a dielectric substrate of an antenna module.

An antenna module according to an aspect of the present disclosure includes a dielectric substrate having a multilayer structure, a first radiating electrode and a ground electrode that are disposed in the dielectric substrate, and a second radiating electrode disposed in a layer between the first radiating electrode and the ground electrode. One of the first radiating electrode and the second radiating electrode is a power feed element to which the radio frequency power is supplied. When the antenna module is viewed in plan from the normal direction of the dielectric substrate, the first radiating electrode and the second radiating electrode at least partially overlap with each other. The thickness of the second radiating electrode is larger than the thickness of the first radiating electrode.

An antenna module according to another aspect of the present disclosure includes a dielectric substrate having a multilayer structure, a radiating electrode and a ground electrode disposed in the dielectric substrate, and a floating electrode disposed in a layer between the radiating electrode and the ground electrode. When the antenna module is viewed in plan from the normal direction of the dielectric substrate, the radiating electrode and the floating electrode at least partially overlap with each other. The radiating electrode is a power feed element to which radio frequency power is supplied, and is configured to radiate a radio wave in a predetermined frequency band. The floating electrode has a dimension that does not cause resonance in the predetermined frequency band.

A communication unit according to still another aspect of the present disclosure includes any one of the above-described antenna modules.

According to the present disclosure, in an antenna module, a thickness of a second radiating electrode provided between a first radiating electrode and a ground electrode in a dielectric substrate is made larger than that of the first radiating electrode. With this configuration, it is possible to substantially increase the thickness of the layer in which the second radiating electrode is disposed, and as a result, it is possible to increase the distance between the ground electrode and the first radiating electrode by the amount of increased thickness of the second radiating electrode even though the number of layers is the same. Therefore, it is possible to expand the frequency band width of the antenna module without changing the number of layers in the dielectric substrate.

DETAILED DESCRIPTION OF THE DISCLOSURE

Figure 1:
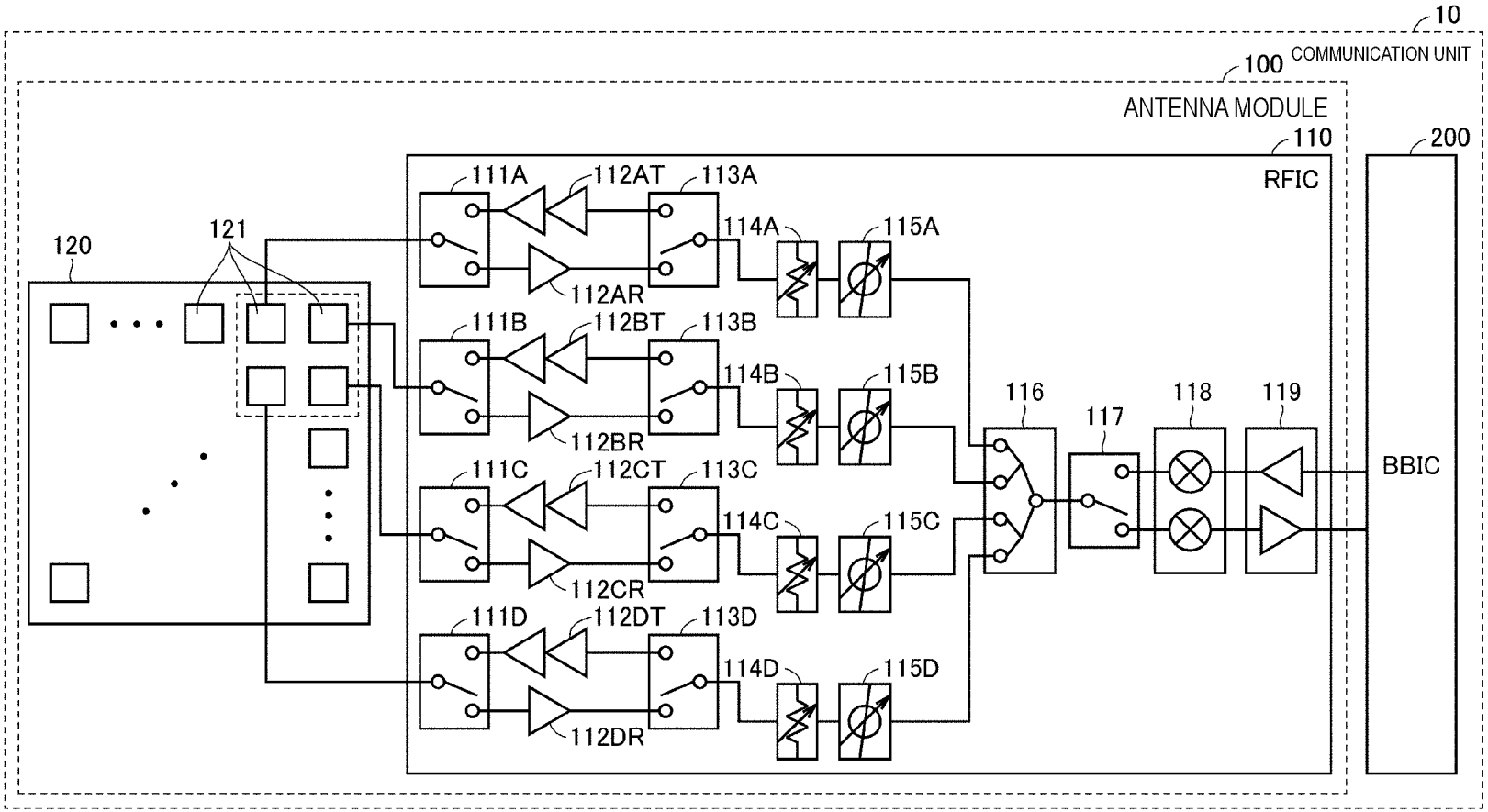
FIG. 1 is a block diagram of a communication unit to which an antenna module according to an embodiment is applied.

Hereinafter, embodiments of the present disclosure will be described in detail with reference to the accompanying drawings. Note that the same or corresponding portions in the drawings are denoted by the same reference symbols, and the description thereof will not be repeated.

Embodiment 1

(Basic Configuration of Communication Unit)

FIG. 1 is a block diagram illustrating an example of a communication unit 10 to which an antenna module 100 according to Embodiment 1 is applied. The communication unit 10 is, for example, a mobile terminal such as a mobile phone, a smartphone, or a tablet; or a personal computer having a communication function; or the like.

According to FIG. 1, the communication unit 10 includes the antenna module 100 and a BBIC 200 that constitutes a baseband signal processing circuit. The antenna module 100 includes an RFIC 110, which is an example of a power feeding circuit, and an antenna array 120. The communication unit 10 up-converts a signal transferred from the BBIC 200 to the antenna module 100 into a radio frequency signal and radiates the signal from the antenna array 120. The communication unit 10 down-converts the radio frequency signal received by the antenna array 120 and processes the signal in the BBIC 200.

Note that, in FIG. 1, for ease of description, among a plurality of power feed elements 121 configuring the antenna array 120, only a configuration corresponding to the four power feed elements 121 is illustrated, and configurations corresponding to other power feed elements 121 that have the same configuration are omitted. In the present embodiment, a case in which the power feed element 121 is a patch antenna having a rectangular flat plate shape will be described as an example.

The RFIC 110 includes switches 111A to 111D, 113A to 113D, and 117, power amplifiers 112AT to 112DT, low-noise amplifiers 112AR to 112DR, attenuators 114A to 114D, phase shifters 115A to 115D, a signal combiner/splitter 116, a mixer 118, and an amplifier 119.

When transmitting a radio frequency signal, the switches 111A to 111D and 113A to 113D are switched to the power amplifiers 112AT to 112DT side, and the switch 117 is connected to the transmission-side amplifier in the amplifier 119. When a radio frequency signal is received, the switches 111A to 111D and 113A to 113D are switched to the low-noise amplifiers 112AR to 112DR side, and the switch 117 is connected to the reception-side amplifier in the amplifier 119.

A signal transferred from the BBIC 200 is amplified by the amplifier 119, and is up-converted by the mixer 118. A transmission signal, which is an up-converted radio frequency signal, is divided into four waves by the signal combiner/splitter 116. The waves pass through four signal paths, and are fed to the power feed elements 121 different from one another. At this time, the directivity of the antenna array 120 may be adjusted by individually adjusting the degree of phase shift in the phase shifters 115A to 115D disposed in the respective signal paths.

Reception signals which are the radio frequency signals received by the power feed elements 121 respectively go through four different signal paths and are combined by the signal combiner/splitter 116. The combined received signal is down-converted by the mixer 118, amplified by the amplifier 119, and transferred to the BBIC 200.

The RFIC 110 is formed as, for example, a single chip integrated circuit component including the above-described circuit configuration. Alternatively, devices (switch, power amplifier, low-noise amplifier, attenuator, and phase shifter) supporting each power feed element 121 in the RFIC 110 may be formed as a single chip integrated circuit component for each corresponding power feed element 121.

(Structure of Antenna Module)

Figure 2:
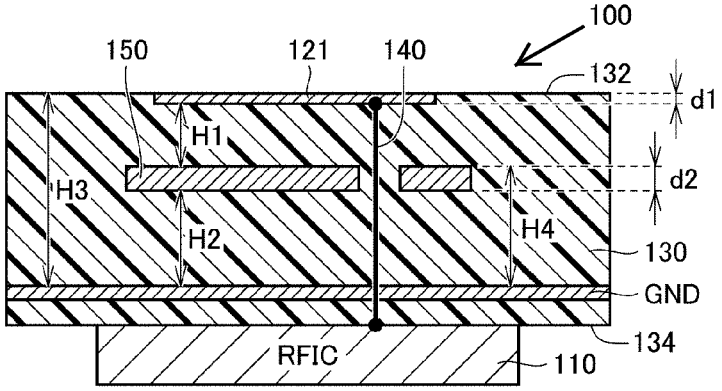
FIG. 2 is a sectional view of an antenna module according to Embodiment 1.

FIG. 2 is a sectional view of the antenna module 100 according to Embodiment 1. According to FIG. 2, the antenna module 100 includes a dielectric substrate 130, a ground electrode GND, a parasitic element 150, and a feed line 140 in addition to the power feed element 121 and the RFIC 110. Note that, in FIG. 2, a description will be given of a case where only one power feed element 121 is disposed for ease of description, but a configuration in which the plurality of power feed elements 121 is disposed may be employed. Further, in the following description, the power feed element 121 and the parasitic element 150 are collectively referred to as a "radiating electrode".

The dielectric substrate 130 is a substrate in which a resin such as epoxy or polyimide is formed as a multilayer structure, for example. Further, the dielectric substrate 130 may be formed using a liquid crystal polymer (LCP) having a lower permittivity or a fluorine-based resin.

The power feed element 121 is disposed on a first surface 132 of the dielectric substrate 130 or in the inner layer of the dielectric substrate 130. In the example of FIG. 2, the power feed element 121 is embedded in the dielectric substrate 130 such that the first surface 132 of the dielectric substrate 130 and the surface of the power feed element 121 are at the same level.

The RFIC 110 is mounted on a second surface 134 (mounting plane) on an opposite side of the first surface 132 of the dielectric substrate 130 via an electrode for connection such as a solder bump (not illustrated). The ground electrode GND is disposed between the layer in which the power feed element 121 is disposed and the second surface 134 in the dielectric substrate 130.

The parasitic element 150 is disposed in the layer between the power feed element 121 and the ground electrode GND in the dielectric substrate 130 so as to face the power feed element 121. The size of the parasitic element 150 (area of the radiating surface) is larger than the size of the power feed element 121, and the power feed element 121 is disposed to entirely overlap with the parasitic element 150 when the antenna module 100 is viewed from the normal direction of the first surface 132 of the dielectric substrate 130. A thickness d2 of the parasitic element 150 is larger than a thickness d1 of the power feed element 121 (d2>d1).

The feed line 140 penetrates through the ground electrode GND and the parasitic element 150 from the RFIC 110, and is connected to the power feed element 121. The feed line 140 supplies the radio frequency power from the RFIC 110 to the power feed element 121. Although not illustrated in the figure, a through-hole through which the feed line 140 passes is formed in the ground electrode GND.

Figure 3:
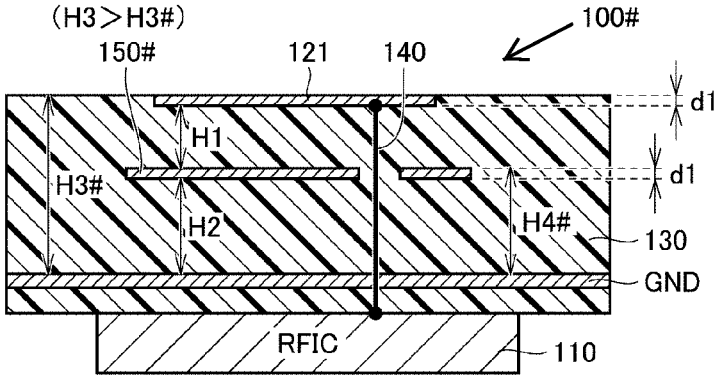
FIG. 3 is a sectional view of an antenna module of Comparative Example.

FIG. 3 is a sectional view of an antenna module 100# according to Comparative Example. The antenna module 100# basically has the same configuration as the antenna module 100 in FIG. 2 except for the thickness of a parasitic element 150#. The parasitic element 150# of the antenna module 100# has the same thickness (d1) as that of the power feed element 121. A distance between the power feed element 121 and the parasitic element 150# is made H1 as the same with the antenna module 100. Further, a distance between the parasitic element 150# and the ground electrode GND is made H2 also as the same with the antenna module 100. In this case, a distance H3 between the ground electrode GND and the power feed element 121 in the antenna module 100 is longer than a distance H3# between the ground electrode GND and the power feed element 121 in the antenna module 100# by a difference (d2−d1) in the thickness between the parasitic elements.

In general, it is known that the frequency band width of a radio wave that may be radiated from the radiating electrode is determined by the strength of the electromagnetic field coupling between the radiating electrode and the ground electrode. As the strength of the electromagnetic field coupling becomes stronger, the frequency band width decreases, and as the strength of the electromagnetic field coupling becomes weaker, the frequency band width increases. Further, the strength of the electromagnetic field coupling becomes stronger as the distance between the radiating electrode and the ground electrode becomes shorter, and the strength of the electromagnetic field coupling becomes weaker as the distance between the radiating electrode and the ground electrode becomes longer.

Further, the electromagnetic field coupling may occur not only on the main surface of the radiating electrode in the ground electrode side but also on the side surface thereof. For this reason, when the distance between the radiating electrode and the ground electrode is constant, the strength of the electromagnetic field coupling becomes stronger as the thickness of the radiating electrode decreases, and the strength of the electromagnetic field coupling becomes weaker as the thickness of the radiating electrode increases. That is, in this case, when the thickness of the radiating electrode increases, the distance between the upper surface (that is, the surface opposite to the ground electrode) of the radiating electrode and the ground electrode increases, and thus the strength of the electromagnetic field coupling becomes weaker.

Here, in a configuration in which, between the radiating electrode (first radiating electrode) and the ground electrode, another radiating electrode (second radiating electrode) is disposed, a frequency band width of a radio wave that may be radiated from the first radiating electrode depends on the strength of the electromagnetic field coupling between the first radiating electrode and the second radiating electrode. On the other hand, a frequency band width of a radio wave that may be radiated from the second radiating electrode depends on the strength of the electromagnetic field coupling between the second radiating electrode and the ground electrode.

Further, a distance H4 from the ground electrode GND to the upper surface of the parasitic element 150 in the antenna module 100 is longer than a distance H4# from the ground electrode GND to the upper surface of the parasitic element 150# in the antenna module 100# by the difference (d2−d1) in the thickness between the parasitic elements. Therefore, with respect to the radio waves radiated from the parasitic elements 150 and 150#, the frequency band width is wider in the antenna module 100 than in the antenna module 100# of Comparative Example.

Here, in order to expand the frequency band of a radio wave radiated from a radiating electrode, it is basically necessary to increase a thickness of a dielectric substrate. However, when the number of layers of the dielectric substrate is increased, the number of laminating steps in the manufacturing process increases, and thus the manufacturing cost may increase.

As in Embodiment 1, by increasing the thickness of the parasitic element disposed between the power feed element and the ground electrode, the frequency band width of a radio wave radiated from the parasitic element (radiating electrode) may be expanded without increasing the number of layers in the dielectric substrate.

Figure 4A:
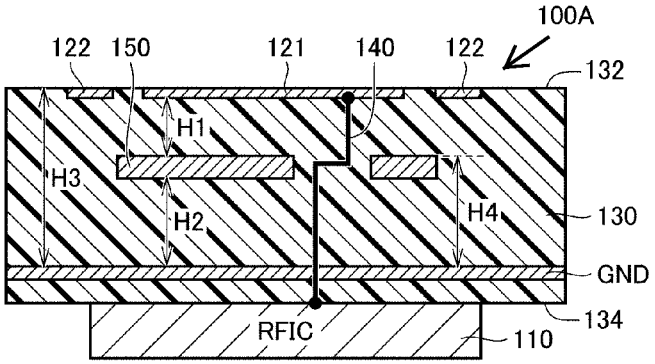
FIGS. 4A and 4B Each of FIGS. 4A and 4B is a diagram for describing a configuration of an antenna module used in a simulation.
Figure 4B:
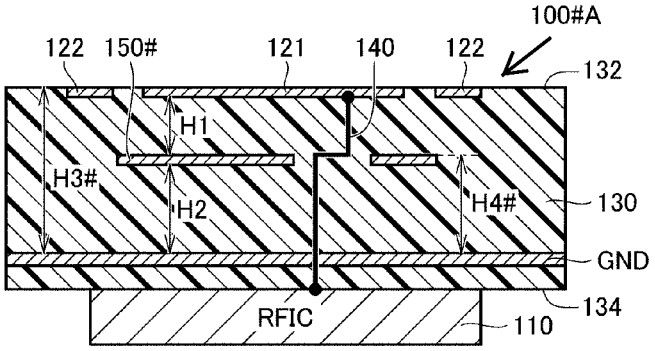

Next, a description will be given of a result of a simulation for the difference in the frequency band width when the thickness of the parasitic element is changed as illustrated in FIG. 2 and FIG. 3. Each of FIGS. 4A and 4B is a sectional view of an antenna module used in the simulation. An antenna module 100A in FIG. 4A is an antenna module according to Embodiment 1, and an antenna module 100#A in FIG. 4B is an antenna module of Comparative Example.

Figure 5:
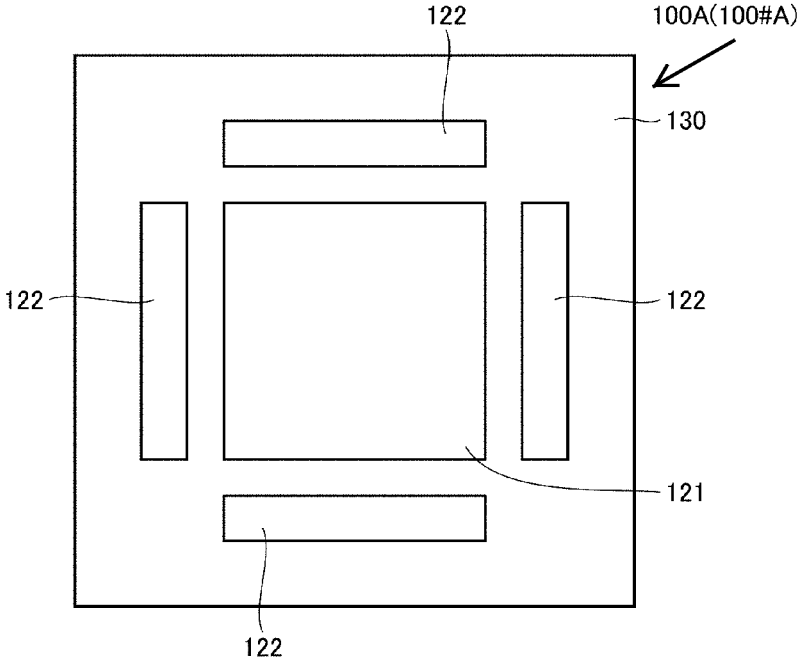
FIG. 5 is a plan view of the antenna module in FIGS. 4A and 4B.

The antenna modules 100A and 100#A in FIG. 4A and FIG. 4B differ from the antenna modules in FIG. 2 and FIG. 3 in that strip-shaped parasitic elements 122 are disposed along each side of the power feed element 121 on the first surface 132 of the dielectric substrate 130 as illustrated in a plan view of FIG. 5, and the feed line 140 is offset in the layer of the parasitic elements 150 and 150#. The configurations of other portions are the same as those of the antenna modules in FIG. 2 and FIG. 3. That is, the thickness of the parasitic element 150 of the antenna module 100A is larger than the thickness of the parasitic element 150# of the antenna module 100#A.

The addition of the parasitic element 122 generates a multiple resonance and has an effect of expanding the frequency band width.

Figure 6:
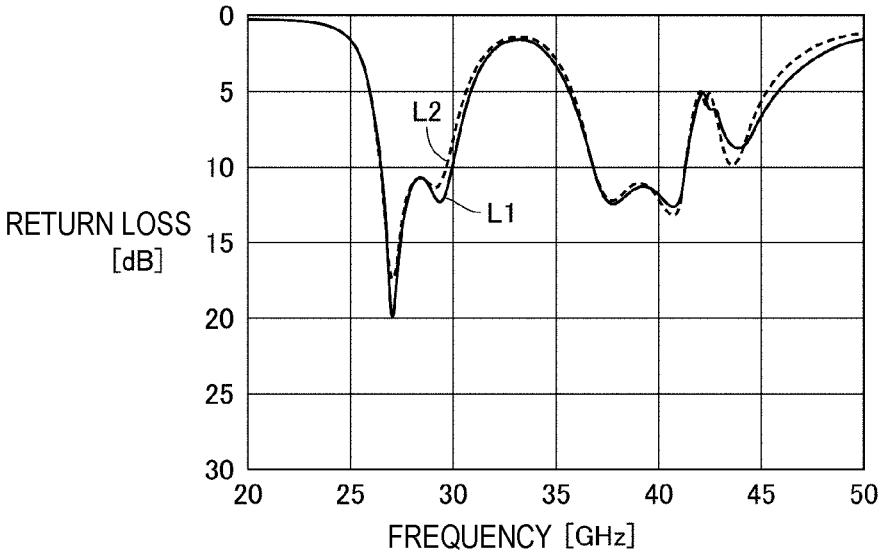
FIG. 6 is a diagram illustrating an example of a simulation result.

FIG. 6 is a diagram illustrating a result of a simulation for the characteristics of the antenna modules in FIG. 4A and FIG. 4B. In FIG. 6, the horizontal axis represents frequency, and the vertical axis represents return loss. The solid line L1 indicates the characteristics of the antenna module 100A in FIG. 4A, and the dashed line L2 indicates the characteristics of the antenna module 100#A in FIG. 4B. Note that in FIG. 6, the parasitic element is dominant at the resonant frequency in the 28 GHz band (around 25 to 30 GHz), and the power feed element 121 is dominant at the resonant frequency in the 38.5 GHz band (around 35 to 45 GHz).

It is found in FIGS. 4A and 4B that the distance H2 between the ground electrode GND and the parasitic element 150 or the parasitic element 150# and the distance H1 between the parasitic element 150 or the parasitic element 150# and the power feed element 121 do not change, but the distance H4 from the ground electrode GND to the upper surface of the parasitic element 150 increases since the thickness of the parasitic element 150 is made larger than the thickness of the parasitic element 150#. The band width in the 38.5 GHz band is dominated by the distance H1, thereby making the change thereof small. On the other hand, the frequency band width in the 28 GHz band expands since the distance H4 corresponding to the antenna thickness dominant in the 28 GHz band increases although the distance H2 does not change. In fact, for the 28 GHz band, the frequency band width in which the reflection loss is 10 dB or more is 26.5 to 30.0 GHz in the antenna module 100A in FIG. 4A, and is 26.5 to 29.5 GHz in the antenna module 100#A in FIG. 4B of Comparative Example. That is, the frequency band width of the antenna module 100A of Embodiment 1 in which the thickness of the parasitic element is increased becomes wider.

Note that the frequency band width in the 38.5 GHz band may be expanded as follows: the distance H3 is elongated by increasing the thickness of the parasitic element 150, and the distance H2 is shortened and the distance H1 is elongated by bringing the parasitic element 150 closer to the ground electrode GND. In addition, it is also possible to balance the expanding widths of the frequency band width in the 28 GHz band and the 38.5 GHz band.

As described above, by increasing the thickness of the parasitic element disposed between the power feed element and the ground electrode, it is possible to expand the frequency band width of a specific band without increasing the number of layers in the dielectric substrate.

Note that in an actual design of a device, the size (thickness) of an antenna module is limited by the size of other components for the device. That is, a thickness of an antenna module may not be increased without limitation for the purpose of expanding the frequency band width.

In the antenna module described above, during manufacture, the layers are pressurized in the thickness direction while being heated after the layers are stacked, and thus the layers of dielectric and the radiating electrodes are brought into close contact with each other. At this time, since the thickness of the dielectric material slightly decreases because of pressurization, the thickness of the antenna module becomes thinner than the design value in the manufacturing process, and the frequency band width may become slightly narrower than the desired frequency band width.

On the other hand, in a radiating electrode formed of a metal material such as copper, the thickness hardly changes because of pressurization in the manufacturing process of the antenna module. Therefore, by increasing the thickness of the parasitic element 150 made of a metal as in Embodiment 1, it is possible to suppress a decrease in the thickness of the antenna module in the manufacturing process. That is, it is possible to achieve an effect that the reduction of the frequency band width compared with the design value is suppressed in the manufacturing process, rather than that the frequency band width is further expanded compared with the design value.

(Modification 1)

In Embodiment 1, a configuration has been described in which the entire thickness of the flat plate shaped parasitic element disposed between the power feed element and the ground electrode is increased, but the configuration in which the thickness of the parasitic element is increased is not limited thereto.

Figure 7:
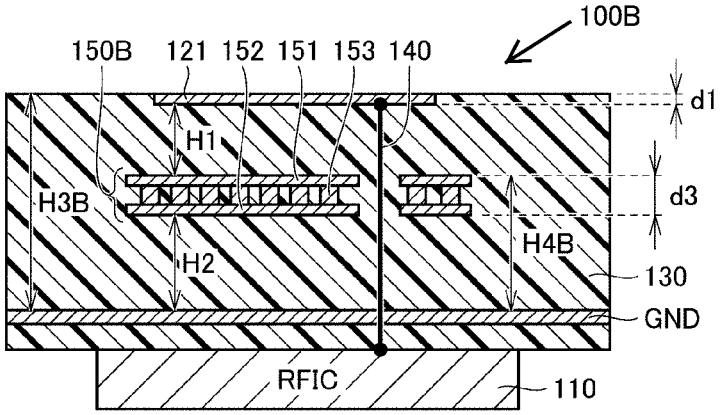
FIG. 7 is a sectional view of an antenna module according to Modification 1.

FIG. 7 is a sectional view of an antenna module 100B according to Modification 1. According to FIG. 7, in Modification 1, a parasitic element 150B is formed of two flat plate shaped electrodes 151 and 152 disposed in different layers in the dielectric substrate 130, and a plurality of vias 153 electrically connecting the two electrodes 151 and 152.

The two electrodes 151 and 152 are metal plates (for example, copper) having the same shape and the same size (dimension) as one another. Note that the thickness of the two electrodes 151 and 152, and the dimension and the number of the vias 153 are appropriately designed such that the resonant frequency of the parasitic element 150B becomes a desired frequency.

By configuring the parasitic element 150B as described above, an overall thickness d3 of the parasitic element 150B may be made thicker than that in the case of Comparative Example in FIG. 3 (d3>d1). Then, when the distance between the power feed element 121 and the parasitic element 150B is made H1 and the distance between the parasitic element 150B and the ground electrode GND is made H2 respectively as the same in the case of Comparative Example, it is possible to make a distance H3B from the ground electrode GND to the power feed element 121 longer than the distance H3# in the case of Comparative Example in FIG. 3 described above. Further, it is possible to make a distance H4B from the ground electrode GND to the upper surface of the parasitic element 150B longer than the distance H4# in the case of Comparative Example in FIG. 3 described above. With this, the frequency band width in the 28 GHz band may be expanded compared with the antenna module 100# of Comparative Example.

(Modification 2)

Figure 8:
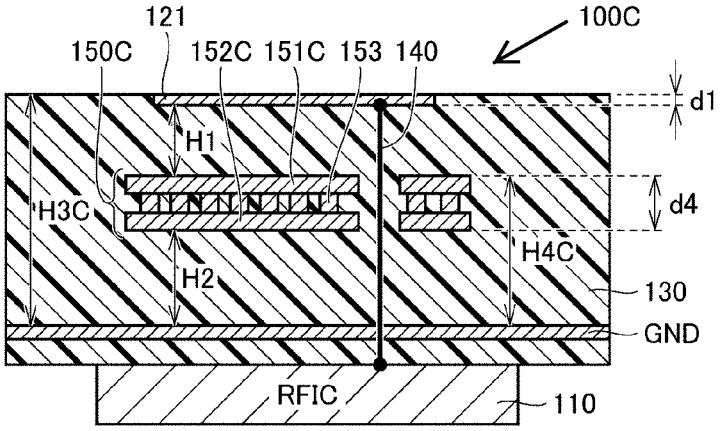
FIG. 8 is a sectional view of an antenna module according to Modification 2.

FIG. 8 is a sectional view of an antenna module 100C according to Modification 2. The antenna module 100C is an example of a configuration in which the thicknesses of the two electrodes of the parasitic element 150B in the above-described Modification 1 are further increased. More specifically, the thicknesses of two electrodes 151C and 152C included in a parasitic element 150C of the antenna module 100C are thicker than the thicknesses of the two electrodes 151 and 152 in FIG. 7 and also thicker than the thickness of the power feed element 121.

By adopting the configuration in the above, a distance H3C between the ground electrode GND and the power feed element 121 becomes longer than the distance H3B in the case of Modification 1 since an entire thickness d4 of the parasitic element 150C may further be made larger than the thickness d3 of the parasitic element 150B. Further, a distance H4C from the ground electrode GND to the upper surface of the parasitic element 150C becomes further longer than the distance H4B in the case of Modification 1. With this, the frequency band width in the 28 GHz band may further be expanded as compared with the case of Modification 1.

(Modification 3)

In Embodiment 1, Modification 1 and Modification 2, the configuration has been described in which the power feed element 121 is disposed on the first surface 132 of the dielectric substrate 130 and the parasitic element is disposed between the power feed element 121 and the ground electrode GND. However, the positions of the power feed element 121 and the parasitic element may be inverted. In addition, in Embodiment 1, Modification 1 and Modification 2, the power feed element 121 covers the 38.5 GHz and the parasitic element covers the 28 GHz band. However, the power feed element 121 may cover the 28 GHz band and the parasitic element may cover 38.5 GHz inversely to the above.

Figure 9:
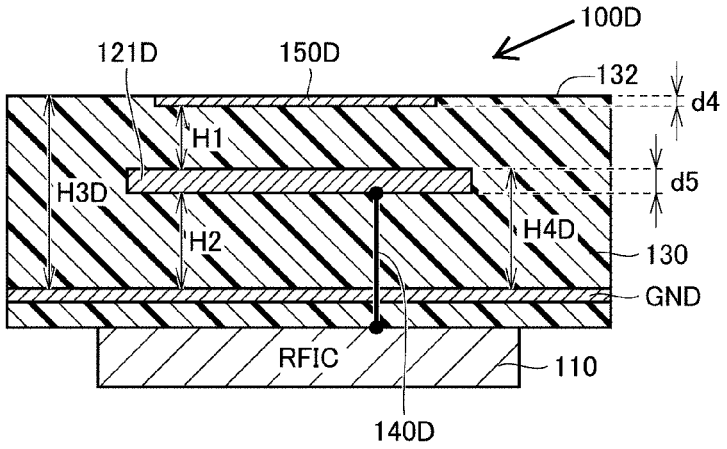
FIG. 9 is a sectional view of an antenna module according to Modification 3.

FIG. 9 is a sectional view of an antenna module 100D according to Modification 3. According to FIG. 9, in the antenna module 100D of Modification 3, a parasitic element 150D is disposed on the first surface 132 of the dielectric substrate 130, and a power feed element 121D is disposed between the parasitic element 150D and the ground electrode GND. Then, the radio frequency power is supplied from the RFIC 110 to the power feed element 121D through a feed line 140D. In addition, in the antenna module 100D, the parasitic element 150D covers the 38.5 GHz band, and the power feed element 121 covers the 28 GHz band.

In the case of Modification 3, a thickness d5 of the power feed element 121D is designed to be larger than the thickness d4 of the parasitic element 150D. With this, it is possible to make a distance H3D between the parasitic element 150D and the ground electrode GND longer than in the case where the thickness of the power feed element 121D is d4 which is the same as the thickness of the parasitic element 150D. Further, compared with the above-described case, a distance H4D from the ground electrode GND to the upper surface of the power feed element 121D may be made longer. Therefore, compared with the case where the thickness of the power feed element 121D is d4, the frequency band width of the 28 GHz band may be expanded.

Note that, even in a case where the power feed element is disposed between the parasitic element and the ground electrode as in Modification 3, the power feed element may have the configuration as in Modification 1 or Modification 2.

Embodiment 2

In Embodiment 1, there has been described the configuration for expanding the frequency band width by increasing the thickness of the radiating electrode disposed in the inner layer side of the dielectric substrate, of the antenna module including two radiating electrodes (a power feed element and a parasitic element) in the thickness direction of the dielectric substrate.

In Embodiment 2, there will be described a configuration for expanding the frequency band width as in Embodiment 1 by disposing a floating electrode that does not function as a radiating electrode in a dielectric substrate, of an antenna module including one radiating electrode (power feed element) in the thickness direction.

That is, in Embodiment 1, a description has been given of a configuration in which the thickness of the radiating electrode disposed in the inner layer side is increased to expand the frequency band width of a specific band in the antenna module covering a plurality of bands. The technical idea of expanding of the frequency band width by increasing the thickness of the electrode disposed in the inner layer side may be applied to an antenna module covering a single band. Therefore, in Embodiment 2, an antenna module covering a single band will be described.

Note that the configuration described in Embodiment 2 is not limited to the antenna module covering a single band, and may cover a plurality of bands by further including a parasitic element or the like.

Figure 10:
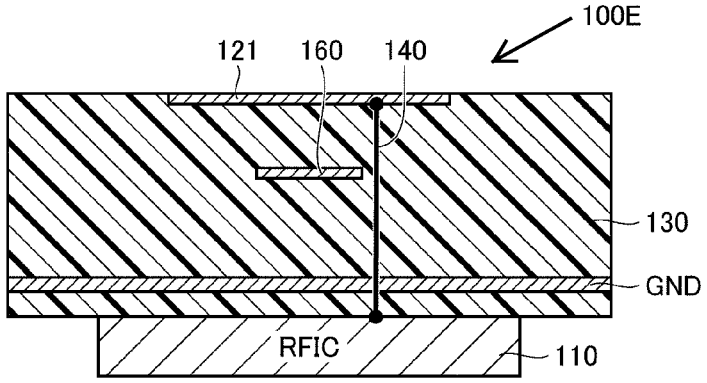
FIG. 10 is a sectional view of an antenna module according to Embodiment 2.

FIG. 10 is a sectional view of an antenna module 100E according to Embodiment 2. According to FIG. 10, the antenna module 100E has a configuration in which the parasitic element 150 is replaced by a floating electrode 160 as compared with the antenna module 100 in FIG. 2.

The floating electrode 160 is made of a metal material such as copper, as with the power feed element 121 and the parasitic element 150. The floating electrode 160 is disposed in a layer between the power feed element 121 and the ground electrode GND in the dielectric substrate 130. In addition, the floating electrode 160 is disposed at a position at least partially overlapping with the power feed element 121 when the antenna module 100E is viewed in plan.

The floating electrode 160 is formed in a circular shape or a polygonal shape. When the wavelength of the radio frequency signal radiated from the power feed element 121 is denoted as λ, in a case where the floating electrode 160 has a circular shape, the length of the diameter is made less than λ/4, and in a case where the floating electrode 160 has a polygonal shape, the length of each side or each diagonal line is made less than λ/4. By forming the floating electrode 160 in the dimension described above, it is possible to make the resonant frequency thereof outside the frequency band width of the radio frequency signal radiated from the antenna module. Therefore, the floating electrode 160 does not function as a radiating electrode in the antenna module 100E.

As described above, by disposing the floating electrode 160 that does not function as the radiating electrode between the radiating electrode (power feed element 121) and the ground electrode GND, the copper content in the thickness direction of the dielectric substrate 130 increases, thereby it is possible to lessen the thickness decrease of the layer in which the floating electrode 160 is disposed in the manufacturing process. With this, in the antenna module 100E, the distance between the power feed element 121 and the ground electrode GND may be made longer than in the case where the floating electrode 160 is not disposed. Therefore, it is possible to expand the frequency band width of a specific band without increasing the number of layers in the dielectric substrate 130.

(Modification 4)

In Modification 3, the configuration in which one floating electrode is provided for the power feed element has been described. However, the number of floating electrodes is not limited thereto, and a plurality of floating electrodes may be provided.

Figure 11:
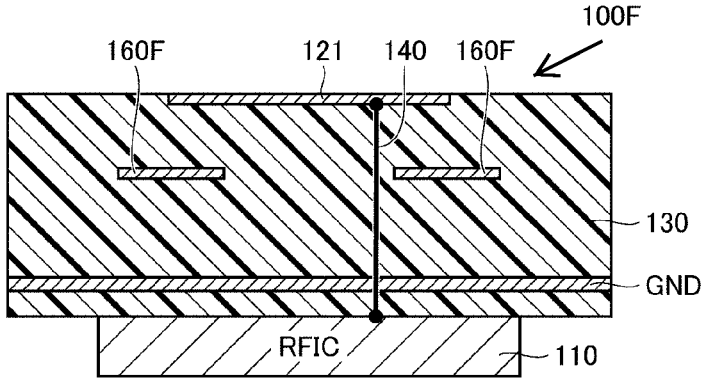
FIG. 11 is a sectional view of an antenna module according to Modification 4.
Figure 12:
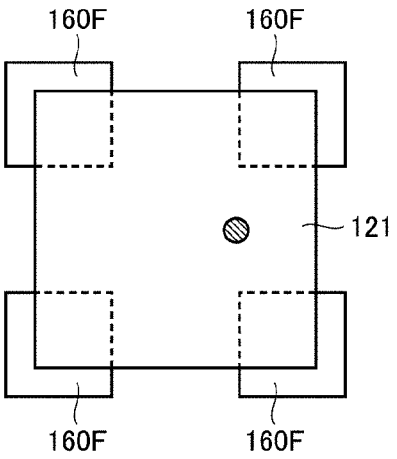
FIG. 12 is a diagram for describing a positional relationship between a radiating electrode and a floating electrode when the antenna module in FIG. 11 is viewed in plan.

FIG. 11 is a sectional view of an antenna module 100F according to Modification 4. According to FIG. 11, in the antenna module 100F, a plurality of floating electrodes 160F is disposed in a layer between the power feed element 121 and the ground electrode GND. FIG. 12 is a diagram for describing a positional relationship between the radiating electrode and the floating electrode when the antenna module is viewed in plan. In the example of the antenna module 100F, four floating electrodes 160F having a rectangular shape are symmetrically disposed with respect to the power feed element 121 respectively so as to at least partially overlap with four corners of the power feed element 121.

By being disposed so as to overlap with the power feed element 121, it is possible to suppress the sinking of the power feed element 121 accompanied by the decrease in the thickness of the dielectric material in the manufacturing process. With this, the distance between the power feed element 121 and the ground electrode GND may be secured, and thus the frequency band width may be made wider than that in the case where the floating electrode is not provided. Further, by symmetrically disposing the floating electrodes 160F with respect to the power feed element 121, the sinking of the power feed element 121 may be made uniform, thereby it is possible to suppress the strain of the power feed element 121 in the manufacturing process.

(Modification 5)

In Modification 5, there will be described a configuration in which the thickness of the floating electrode 160F in the antenna module 100F described with reference to FIG. 11 is further increased.

Figure 13:
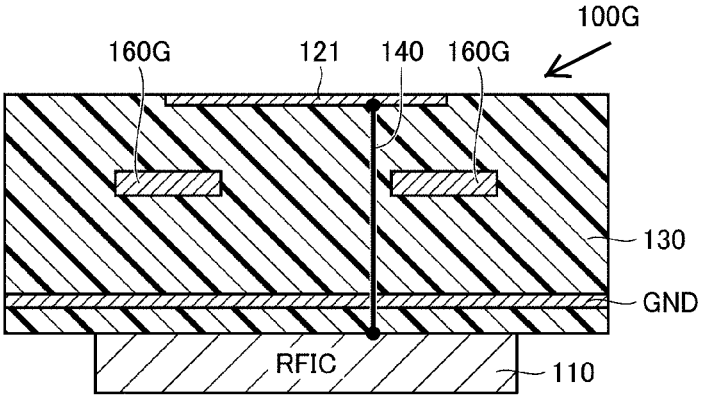
FIG. 13 is a sectional view of an antenna module according to Modification 5.

FIG. 13 is a sectional view of an antenna module 100G according to Modification 5. The thickness of a floating electrode 160G in the antenna module 100G is made larger than that of the floating electrode 160F of the antenna module 100F in FIG. 11. With this, the copper content in the normal direction of the dielectric substrate 130 may be increased, thereby it is possible to further increase the distance between the power feed element 121 and the ground electrode GND as compared with the case in FIG. 11.

Therefore, the frequency band width of the power feed element 121 in the antenna module 100G may further be expanded.

(Modification 6)

Figure 14:
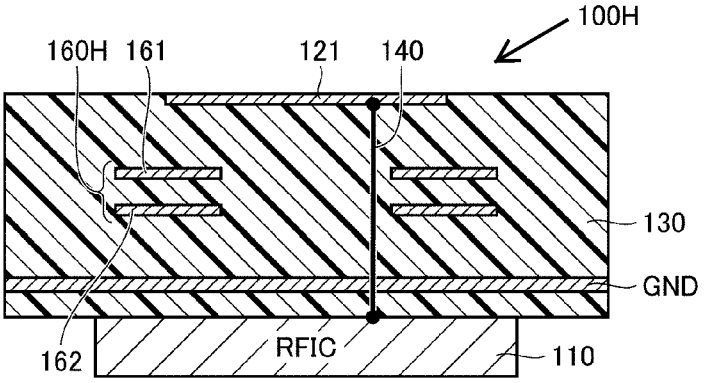
FIG. 14 is a sectional view of an antenna module according to Modification 6.

FIG. 14 is a sectional view of an antenna module 100H according to Modification 6. The antenna module 100H has a configuration in which the floating electrodes described in Modification 4 are provided in a plurality of layers.

According to FIG. 14, the antenna module 100H includes two electrodes 161 and 162 disposed in different layers of the dielectric substrate 130 as a floating electrode 160H. The electrodes 161 and 162 are formed to have the same shape and the same size (dimension) as each other. The electrodes 161 and 162 are disposed so as to overlap with each other when the antenna module 100H is viewed in plan from the normal direction. Although not illustrated, a plurality of floating electrodes 160H including the two electrodes 161 and 162 is symmetrically disposed so as to at least partially overlap with the four corners of the power feed element 121, as described in FIG. 12 of Modification 4.

As described above, by disposing the plurality of floating electrodes in different layers in the thickness direction of the dielectric substrate, it is possible to further increase the copper content in the thickness direction of the dielectric substrate. Therefore, it is possible to suppress a decrease in the distance between the power feed element 121 and the ground electrode GND in the manufacturing process, thereby it is possible to expand the frequency band width of a specific band.

Note that an example in which the two electrodes 161 and 162 of the floating electrode 160H have the same shape and the same size is described in FIG. 14, but the shapes and/or sizes of the electrodes 161 and 162 may be different from each other. However, even in the case above, it is preferable to symmetrically dispose the set of electrodes 161 with respect to the power feed element 121, and it is also preferable to symmetrically dispose the set of electrodes 162 with respect to the power feed element 121.

(Modification 7)

Figure 15:
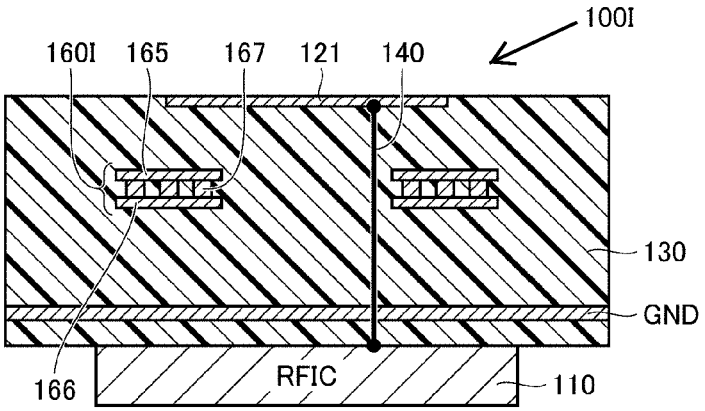
FIG. 15 is a sectional view of an antenna module according to Modification 7.

FIG. 15 is a sectional view of an antenna module 100I according to Modification 7. The antenna module 100I has a configuration in which two electrodes of the floating electrode in the antenna module 100H in FIG. 14 are electrically connected to each other by vias.

With reference to FIG. 15, the antenna module 100I includes, as a floating electrode 160I, two electrodes 165 and 166 disposed in different layers of the dielectric substrate 130 and a plurality of vias 167 made of a metal (for example, copper) electrically connecting therebetween. The electrodes 165 and 166 are formed to have the same shape and the same size, and are disposed so as to overlap with each other when the antenna module 100I is viewed in plan from the normal direction. Although not illustrated, a plurality of floating electrodes 160I including the two electrodes 165 and 166 is symmetrically disposed so as to at least partially overlap with the four corners of the power feed element 121, as described in FIG. 12 of Modification 4.

As described above, by connecting the two electrodes 165 and 166 of the floating electrode 160I with vias made of a metal, it is possible to suppress a decrease in the distance between the two electrodes 165 and 166 in the manufacturing process. Therefore, it is possible to suppress a decrease in the distance between the power feed element 121 and the ground electrode GND in the manufacturing process, thereby it is possible to expand the frequency band width of a specific band.

(Modification 8)

In the floating electrode 160I of the antenna module 100I of Modification 7, there has been described the case in which the two electrodes 165 and 166 connected by the vias 167 have the same shape and the same size.

In an antenna module 100J according to Modification 8, there will be described a configuration in which the floating electrode is formed by connecting two electrodes having different shapes and/or sizes with vias.

Figure 16:
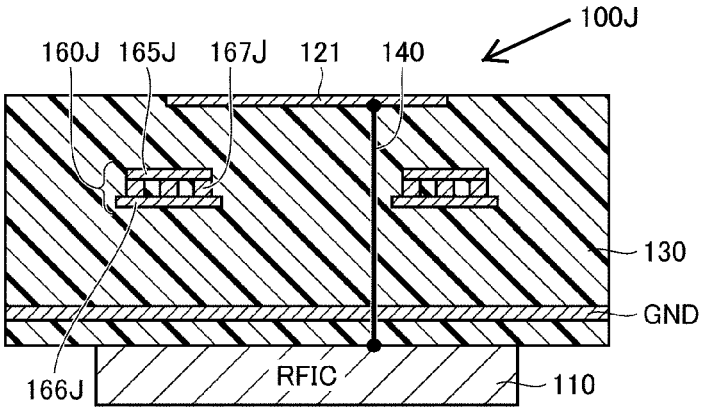
FIG. 16 is a sectional view of an antenna module according to Modification 8.

With reference to FIG. 16, the antenna module 100J includes, as a floating electrode 160J, two electrodes 165J and 166J disposed in different layers in the dielectric substrate 130 and a plurality of vias 167J made of a metal electrically connecting the two electrodes. The electrodes 165J and 166J are formed in different shapes and/or sizes from each other. Note that there is illustrated an example in which the size of the electrode 165J is smaller than the size of the electrode 166J in FIG. 16, but the size of the electrode 165J may be larger than the size of the electrode 166J conversely.

Also, in the antenna module 100J of Modification 8, as in Modification 7, a decrease in the distance between layers in which two electrodes are formed is suppressed in the manufacturing process. Thereby, it is possible to suppress a decrease in the distance between the power feed element 121 and the ground electrode GND in the manufacturing process. Therefore, it is possible to expand the frequency band width of a specific band.

Note that both in Modification 7 and Modification 8, the thickness of each electrode included in the floating electrode may be made larger than the thickness of the radiating electrode. Further, the distance between the two electrodes may be further elongated, and the two electrodes may be connected to each other with a longer via. By increasing the copper content in the thickness direction of the dielectric substrate, it is possible to suppress a decrease in the thickness of the dielectric material in the manufacturing process, thereby it is possible to expand the frequency band width of a specific band.

In Embodiment 2, the case where the number of radiating electrodes is one has been described. However, it is also possible to employ a configuration in which two radiating electrodes (a power feed element and a parasitic element) and a floating electrode are included by combining Embodiment 1 and Embodiment 2. Further, a configuration may be employed in which three or more radiating electrodes are provided.

Further, the mounting position of the RFIC is not limited to the second surface of the dielectric substrate, and may be mounted on the first surface of the dielectric substrate at a position different from that of the radiating electrode. In the case above, a through-hole through which the feed line penetrates may not be formed in the ground electrode.

Note that, in the above description, the case has been described as an example in which the radiating electrode (first radiating electrode) disposed on the first surface 132 side of the dielectric substrate 130 is a single flat plate shaped electrode, but the radiating electrode may be a plurality of flat plate shaped electrodes connected by the vias as in the case of the parasitic element 150B in FIG. 7. However, the first radiating electrode may have a configuration in which the first radiating electrode is connected by vias to another electrode disposed between the first radiating electrode and another radiating electrode (second radiating electrode) formed in the inner layer side of the dielectric substrate 130 relative to the first radiating electrode. The other electrode may function as a radiating element, or may not function as a radiating element as in Embodiment 2. In the configuration above, the thickness of the other electrode connected to the first radiating electrode or the thickness of the vias connecting the first radiating electrode and the other electrode is not included in the thickness of the first radiating electrode.

It should be construed that the embodiments disclosed herein are illustrative in all respects and are not restrictive. The scope of the present disclosure is defined by the claims rather than the description of the above-described embodiments, and it is intended to include all modifications within the meaning and scope equivalent to the scope of the claims.

10 COMMUNICATION UNIT
100, 100A to 100J, 100# ANTENNA MODULE
111A to 111D, 113A to 113D, and 117 SWITCH
112AR to 112DR LOW-NOISE AMPLIFIER
112AT to 112DT POWER AMPLIFIER
114A to 114D ATTENUATOR
115A to 115D PHASE SHIFTER
116 SIGNAL COMBINER/SPLITTER
118 MIXER
119 AMPLIFIER
120 ANTENNA ARRAY
121, 121D POWER FEED ELEMENT
122, 150, 150B to 150D, 150# PARASITIC ELEMENT
130 DIELECTRIC SUBSTRATE
132 FIRST SURFACE
134 SECOND SURFACE
140, 140D FEED LINE
151, 151C, 152, 152C, 161, 162, 165, 165J, 166, 166J ELECTRODE
153, 167, 167J VIA
160, 160F to 160J FLOATING ELECTRODE
GND GROUND ELECTRODE

The invention claimed is:

1. An antenna module comprising:
a dielectric substrate having a multilayer structure;
a first radiating electrode and a ground electrode disposed in the dielectric substrate; and
a second radiating electrode disposed in a layer between the first radiating electrode and the ground electrode,
wherein one of the first radiating electrode and the second radiating electrode is a power feed element to which radio frequency power is supplied,
the first radiating electrode and the second radiating electrode at least partially overlap with each other upon viewing the antenna module in plan from a normal direction of the dielectric substrate, and
a thickness of the second radiating electrode is larger than a thickness of the first radiating electrode.

2. The antenna module according to claim 1,
wherein the first radiating electrode is a power feed element, and
the second radiating electrode is a parasitic element.

3. The antenna module according to claim 1,
wherein the first radiating electrode is a parasitic element, and
the second radiating electrode is a power feed element.

4. The antenna module according to claim 1,
wherein the first radiating electrode and the second radiating electrode radiate radio waves in different frequency bands from each other.

5. The antenna module according to claim 1,
wherein the second radiating electrode includes two electrodes having a same shape and a same size disposed in alignment with the normal direction, and a plurality of vias connecting the two electrodes, and
the thickness of the second radiating electrode is a distance between a surface facing the first radiating electrode of an electrode on a side closer to the first radiating electrode of the two electrodes and a surface facing the ground electrode of an electrode on a side closer to the ground electrode of the two electrodes.

6. The antenna module according to claim 5,
wherein a thickness of each of the two electrodes is larger than the thickness of the first radiating electrode.

7. An antenna module comprising:
a dielectric substrate having a multilayer structure;
a radiating electrode and a ground electrode disposed in the dielectric substrate; and
a floating electrode disposed in a layer between the radiating electrode and the ground electrode,
wherein the radiating electrode and the floating electrode at least partially overlap with each other upon viewing the antenna module in plan from a normal direction of the dielectric substrate,
the radiating electrode is a power feed element to which radio frequency power is supplied, and is configured to radiate a radio wave in a predetermined frequency band,
the floating electrode has a dimension not causing resonance in the predetermined frequency band, and
a thickness of the floating electrode is larger than a thickness of the radiating electrode.

8. The antenna module according to claim 7,
wherein upon denoting a wavelength of the radio wave radiated from the radiating electrode as $\lambda$, the floating electrode is provided as a polygonal shape having each side or each diagonal line of less than $\lambda/4$ in length.

9. The antenna module according to claim 7,
wherein upon denoting a wavelength of the radio wave radiated from the radiating electrode as $\lambda$, the floating electrode is formed as a circular shape having a diameter of less than $\lambda/4$ in length.

10. The antenna module according to claim 8,
wherein the floating electrode includes a plurality of first electrodes having a same shape and a same size, and
the plurality of first electrodes are symmetrically disposed with respect to the radiating electrode upon viewing the antenna module in plan from the normal direction of the dielectric substrate.

11. The antenna module according to claim 10, wherein the floating electrode further includes a second electrode provided as corresponding to each of the plurality of first electrodes and disposed so as to overlap with each of the first electrodes in the normal direction.

12. The antenna module according to claim 11, wherein each of the plurality of first electrodes is connected to the second electrode provided as corresponding to each of the plurality of first electrodes by a plurality of vias.

13. The antenna module according to claim 11, wherein each of the plurality of first electrodes has a same shape and a same size as a shape and a size of the second electrode provided corresponding thereto.

14. The antenna module according to claim 11, wherein each of the plurality of first electrodes has a shape different from a shape of the second electrode that is provided as corresponding to each of the plurality of first electrodes.

15. The antenna module according to claim 1 further comprising a power feeding circuit mounted on the dielectric substrate and configured to supply radio frequency power to the power feed element.

16. A communication unit provided with the antenna module according to claim 1.

17. The antenna module according to claim 2, wherein the first radiating electrode and the second radiating electrode radiate radio waves in different frequency bands from each other.

18. The antenna module according to claim 3, wherein the first radiating electrode and the second radiating electrode radiate radio waves in different frequency bands from each other.

19. The antenna module according to claim 2, wherein the second radiating electrode includes two electrodes having a same shape and a same size disposed in alignment with the normal direction, and a plurality of vias connecting the two electrodes, and the thickness of the second radiating electrode is a distance between a surface facing the first radiating electrode of an electrode on a side closer to the first radiating electrode of the two electrodes and a surface facing the ground electrode of an electrode on a side closer to the ground electrode of the two electrodes.

* * * * *